US007335068B2

(12) United States Patent
Dwan et al.

(10) Patent No.: US 7,335,068 B2
(45) Date of Patent: Feb. 26, 2008

(54) BOARD TO BOARD CONNECTOR

(75) Inventors: Swu-Lin Dwan, Taipei (TW); Mickey Wuan, Taipei (TW)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 11/448,027

(22) Filed: Jun. 7, 2006

(65) Prior Publication Data

US 2007/0105407 A1 May 10, 2007

(30) Foreign Application Priority Data

Nov. 4, 2005 (TW) ..... 94219142 U

(51) Int. Cl.
*H01R 13/24* (2006.01)

(52) U.S. Cl. ..... 439/700; 439/66; 439/570

(58) Field of Classification Search ..... 439/700, 439/66, 824, 733.1, 570, 566
See application file for complete search history.

(56) References Cited

U.S. PATENT DOCUMENTS 5,967,856 A * 10/1999 Meller ..... 439/700
6,012,949 A * 1/2000 Lok ..... 439/570
6,083,059 A * 7/2000 Kuan ..... 439/862
6,142,790 A 11/2000 Niitsu ..... 439/66
6,276,941 B1 8/2001 Wu ..... 439/66
7,056,136 B2 * 6/2006 Iwasaki ..... 439/248

* cited by examiner

*Primary Examiner*—Javaid H. Nasri
(74) *Attorney, Agent, or Firm*—Troxell Law Office, PLLC

(57) ABSTRACT

The present invention is to provide a board to board connector, which comprises an insulative housing, a plurality of electrical terminals and a pair of fastening members. The insulative housing has a plurality of terminal chambers which pass from the bottom face through the top face of the base portion thereof for accommodating the electrical terminals. Each terminal includes a contact portion, a fixing portion and a two-way multi-layer U-shaped spring portion connected therebetween. The spring portion has perfect elasticity, and the contact portion is formed with a stopping portion at the end connecting the spring portion, and on the other end forming an abutting portion, which could match with the insulative housing effectively. The fastening members are disposed in the wide slots on two side convex portions of the insulative housing to connect with the PCB to achieve signal transmission.

5 Claims, 2 Drawing Sheets

BOARD TO BOARD CONNECTOR

BACKGROUND OF THE INVENTION

1. Field of the Invention

The present invention relates to a board to board connector, particularly to a board to board connector in which the spring portion has a two-way multi-layer U-shaped structure with perfect resilience and low shrink range, to meet the requirements of high insertion durability.

2. Description of Related Art

Board to board connector mounted, between printed circuit boards (PCBs) is used to provide signal transmission among electronic devices. At present, the board to board connector has two configurations. One is the connector consists of a plug and a receptacle connector, the other is only a simplex connector used alone, i.e. it is a single connector in which the solder portion and contact portion thereof are each connected with a PCB to achieve signal transmission, the structure of this kind of board to board connector is relatively simple.

For example, U.S. Pat. Nos. 6,276,941 and 6,142,790, both disclosed the board to board connectors are of a single connector configuration, and apparent defaults could be found in the two patents. Firstly, the elastic contact portion (abutted against the PCB) and the mounting portion (mounted in the insulative housing) of the terminal define a relatively large angle, and the elastic contact portion surpasses the insulative housing largely, when the contact portion is contacted with the PCB, they need to apply a strong force to press them to the same level with the upper surface of the insulative housing, which is adverse for operation, and the resilience restoring ability of the terminal is relatively poor. Secondly, as time passes, the elastic contact portion would become poor on restoring resilience and surpass further out of the insulative housing, which is adverse for using. On account of the above adverse factors, the existing board to board connectors are to be improved.

SUMMARY OF THE INVENTION

It is a primary object of the present invention to provide a board to board connector, which makes use of a two-way multi-layer U-shaped spring portion structure, to improve the terminal using efficiency and to meet the requirements of high insertion durability.

To achieve the above object, the present invention uses the following arts to achieve its functions. The board to board connector is in a vertical structure, which comprises an insulative housing, a plurality of electrical terminals and a pair of fastening members set on two sides of the insulative housing. Whereinto, the insulative housing has a body portion, the body portion being disposed with a plurality of terminal chambers which pass from the bottom face through the top face thereof for accommodating the electrical terminals. On two sides of the top portion of each terminal chamber, there is disposed with a guarding arm respectively. On two sides of the insulative housing along the axle direction thereof, there is disposed outward with a convex portion respectively, and on the convex portion having a wide slot. Each terminal includes a contact portion, a fixing portion and a two-way multi-layer U-shaped spring portion connected therebetween. The u-shaped spring portion has a perfect elasticity and a small deforming range and could draw back evenly, thus could provide a product of high insertion durability. The contact portion is provided with a stopping portion at the end connecting the spring portion, and on the other end forming an abutting portion. When electrical terminals are assembled within terminal chambers, the stopping portion and the abutting portion could abut against the guarding portions of the terminal chamber to stabilize the terminal. On two sides of the fixing portion, there is formed with multiple crisscross interfering portions which could engage with the walls of the terminal chamber. Along two side edges of the fixing portion, each extends outward a solder leg. The fastening members could be connected with the PCB after being disposed in the insulative housing, the solder legs of the connector are soldered to the PCB to achieve stability and connection, then contact portions abut against another PCB, thus the terminals are connected with upper and lower two pieces of PCBs to achieve stable signal transmission among electronic devices.

The above and other objects, features and advantages of the present invention will become apparent from the following detailed description taken with the accompanying drawings.

DETAILED DESCRIPTION OF THE PREFERRED EMBODIMENTS

Figure 1:
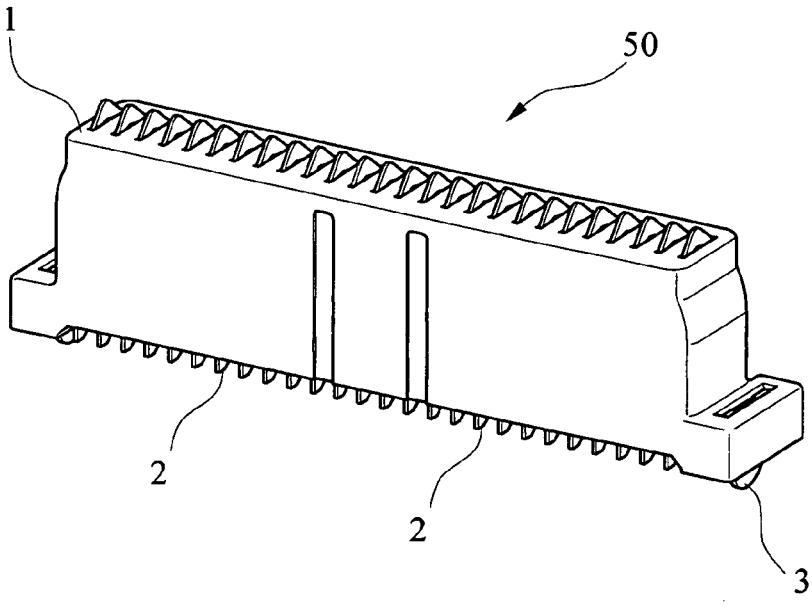
FIG. 1 is a perspective view of a preferred embodiment of the present invention.

Refer to FIG. 1, which shows a preferred embodiment of a board to board connector 50 of the present invention. The board to board connector 50 is of a vertical type structure, which comprises an insulative housing 1, a plurality of electrical terminals 2 and a pair of fastening members 3 for fastening to a PCB. Please refer to FIGS. 2 and 3 for the full view of the said connector, a greater detail of the board to board connector 50 will be described in detail later.

Figure 3:
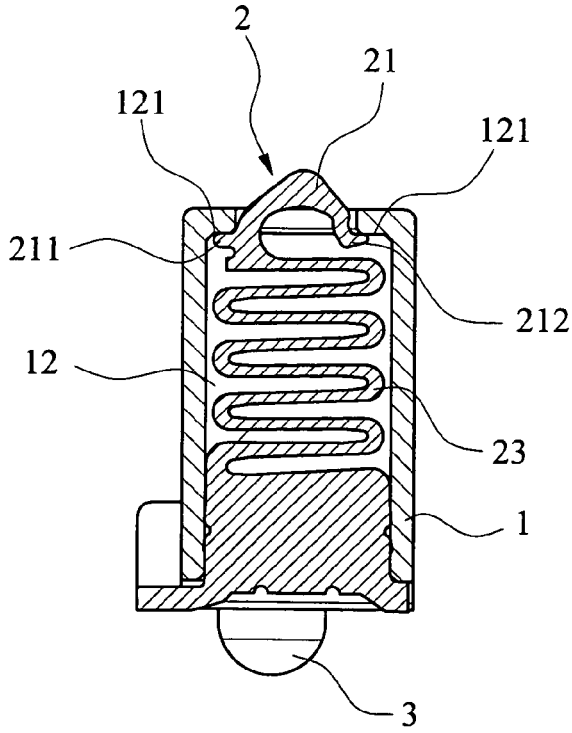
FIG. 3 is a sectional view of the preferred embodiment of the present invention.
Figure 2:
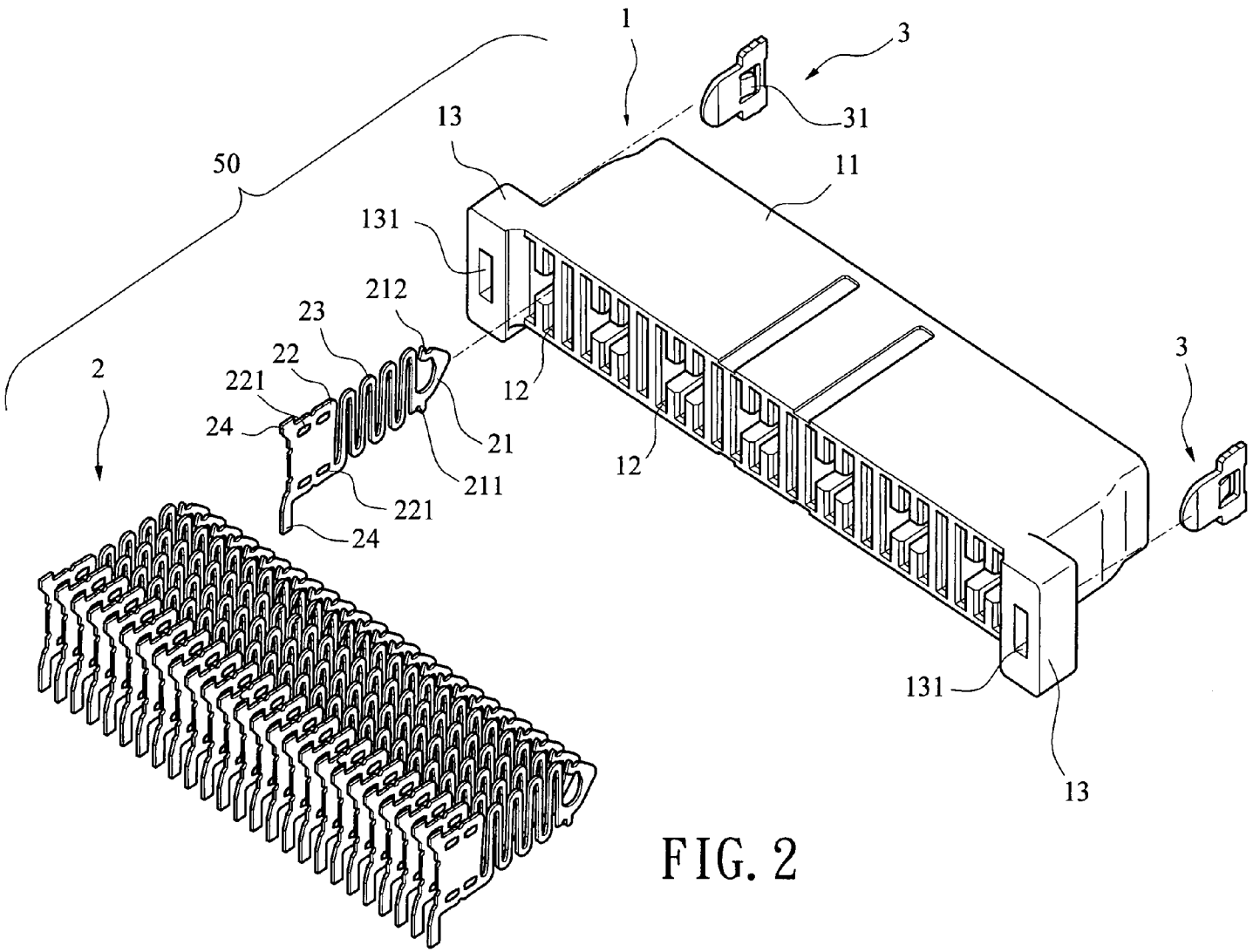
FIG. 2 is an exploded perspective view of the preferred embodiment of the present invention.

Referring to FIGS. 1-3, the insulative hosing 1 has a body portion 11, the body portion 11 being disposed with a plurality of terminal chambers 12 which pass from the bottom face through the top face thereof for accommodating the electrical terminals 2. The terminal chambers 12 are partition-liked, every two terminal chambers 12 separated by a single terminal chamber 12 are communicated with each other so as to be apt to part processing, it is also could reduce the resistance when assembling the electrical terminals 2 for the wall surfaces of the chambers 12 are reduced so as to be convenient for assembly. On two sides of the top portion of each terminal chamber 12, there is disposed with a guarding arm 121 respectively, which is adapted to secure the electrical terminal 12 and prevent the contact portion 21 of the electrical terminal 12 from surpassing the top surface of the insulative housing 1 completely. On two sides of the insulative housing 1 along the axle direction thereof, there is disposed outward with a convex portion 13 respectively, and on the convex portion 13 having a wide slot 131 for inserting the fastening member 3.

The electrical terminals 2 are unitarily stamped from a metal plate, each includes an active contact portion 21, a fixing portion 22 and a two-way multi-layer U-shaped spring portion 23 connected therebetween. The U-shaped spring portion 23 has perfect elasticity and could secure the terminal resilience. When the terminal 2 is under pressure, the multi-layer U-shaped spring portion 23 could bear force on each layer; when the external force is removed, it could restore its original shape at the shortest time, therefore, the using efficiency of the terminal 2 is improved. The contact portion 21 is provided outward with a stopping portion 211 at the end connecting the spring portion 23, and on the other end forming an abutting portion 212. When the electrical terminal 2 is assembled within the terminal chamber 12, the stopping portion 211 and the abutting portion 212 could abut against the guarding portions 121 on two sides of the top portion of the terminal chamber 12, which could not only stabilize the terminal 2, but also could prevent the contact portion 21 from passing through the top face of the insulative housing 1 completely when the resilience is restoring after the external force is removed. On two sides of the fixing portion 22, there is formed with multiple crisscross interfering portions 221 which could engage with the walls of the terminal chamber 12. Along two side edges of the fixing portion 22, there extends outward a solder leg 24 for mounting to the PCB and to secure signal connection.

The fastening member 3 is inserted and disposed within the wide slot 131 of the convex portion 13 on the insulative housing 1 for the convenience of locating and fixing the connector. The structure of the fastening member 3 is relatively simple, the fastening member 3 is in shape of a "T", so as the oblique clasping points 31 disposed inward or outward on the fastening member 3 could engage with the wide slot 131 easily.

In assembly of the board to board connector 50 of the present invention, the electrical terminals 2 are guided into the terminal chambers 12 from the bottom face of the insulative housing 1, the stopping portion 211 and the abutting portion 212 abutting against the guarding portion 121 on the top portion of the terminal chamber 12, the interfering portions 221 of the electrical terminals 2 being engaged with the walls of the terminal chambers 12 to achieve stability, the fastening members 3 are disposed within the wide slots 131. In use, the connector 50 is located on the PCB, and the fastening members 3 together with the solder legs 24 of the electrical terminals 2 are soldered on the PCB, and the contact portions 21 of the connector 50 abut against another PCB. Under the external force, the contact portions 21 are drawn back, at this moment the U-shaped spring portions 23 deform elastically under the pressure. When the external force is removed, the spring portions 23 restore to the original shape due to resilience, and contact portions 21 recover to the original position, the stopping portions 211 and the abutting portions 212 re-abut against the guarding portions 121, which prevents the contact portion 21 surpass the original position due to excessive elasticity during the restoring process, to secure the connector keep in ideal condition all the time to achieve a perfect electrical signal transmission.

While the invention herein disclosed has been described by means of specific embodiments, numerous modifications and variations could be made thereto by those skilled in the art without departing from the scope and spirit of the invention set forth in the claims.

What is claimed is:

1. A board to board connector, comprising an insulative housing, a plurality of electrical terminals and a pair of fastening members, wherein said insulative housing is disposed with a plurality of terminal chambers which each passes from a bottom face through a top face thereof for accommodating each of said electrical terminals, each electrical terminal includes a contact portion, a fixing portion and a two-way multi-layer U-shaped spring portion connected therebetween, said fastening members each is secured on either side of said insulative housing and mounted on a PCB to achieve signal transmission, wherein each terminal chamber is formed with a guarding arm on two sides of a top portion thereof, and a wide slot for inserting said fastening member is disposed on either side of said insulative housing; said contact portion of each electrical terminal is extended outward a stopping portion at an end thereof connecting said spring portion, and an abutting portion forming on an other end thereof; said fixing portion having a plurality of interfering portions each engaging with a wall of said terminal chamber.

2. The board to board connector of claim 1, wherein said fastening members each is formed as of a "T" shape structure, and has an oblique clasping point on said fastening member engaging with said wide slot closely.

3. A board to board connector, comprising an insulative housing, a plurality of electrical terminals and a pair of fastening members, wherein said insulative housing includes a plurality of narrow partition terminal chambers, each chamber having a large bottom opening communicating with a small top opening for accommodating each of said electrical terminals, each electrical terminal includes a top C-shaped contact portion, a sheet-shaped bottom fixing portion and a spring portion having a multi-layer horizontal and continuous U-shaped winding portion connected integrally between the contact portion and the fixing portion, the top opening only has the top C-shaped contact portion projected out thereof to contact with an other board connector, said fastening members each is secured on either side of said insulative housing and mounted on a PCB to achieve signal transmission, wherein each terminal chamber is formed with a guarding arm on two sides of the top opening thereof, and a wide slot for inserting said fastening member is disposed on either side of said insulative housing; said contact portion of each electrical terminal is extended outward a stopping portion at an end thereof connecting said spring portion, and an abutting portion forming on an other end thereof; said fixing portion having a plurality of interfering portions each engaging with a wall of said terminal chamber.

4. The board to board connector according to claim 3, wherein said fastening members each is formed as of a "T" shape structure, and has an oblique clasping point on an upper middle of said fastening member engaging with said wide slot closely.

5. The board to board connector according to claim 3, wherein the abutting portion is formed at a mouth of the C-shaped contact portion and the stopping portion is opposite to the abutting portion, each portion is abutting against the respective guarding arm on the top portion of the terminal chamber.

* * * * *